US012324470B2

(12) United States Patent
Ahl et al.

(10) Patent No.: US 12,324,470 B2
(45) Date of Patent: Jun. 10, 2025

(54) GARMENT WITH ADJUSTABLE ATTACHMENT SYSTEM

(71) Applicant: CIRK-L AB, Malmö (SE)

(72) Inventors: Christian Ahl, Malmö (SE); Kasimir Hellström, Hurva (SE); Johan Erik Martin Haglund, Eslöv (SE)

(73) Assignee: CIRK-L AB, Malmö (SE)

( * ) Notice: Subject to any disclaimer, the term of this patent is extended or adjusted under 35 U.S.C. 154(b) by 57 days.

(21) Appl. No.: 17/800,127

(22) PCT Filed: Feb. 17, 2021

(86) PCT No.: PCT/SE2021/050133
§ 371 (c)(1),
(2) Date: Aug. 16, 2022

(87) PCT Pub. No.: WO2021/167520
PCT Pub. Date: Aug. 26, 2021

(65) Prior Publication Data

US 2023/0072668 A1 Mar. 9, 2023

(30) Foreign Application Priority Data

Feb. 18, 2020 (SE) ..... 2050181-3

(51) Int. Cl.
*A41F 1/00* (2006.01)
*A41D 13/00* (2006.01)

(52) U.S. Cl.
CPC ..... *A41F 1/00* (2013.01); *A41D 13/0012* (2013.01)

(58) Field of Classification Search
CPC .... A41F 1/00; A41F 17/04; A45F 5/02; A45F 5/021; A45F 2005/026; A45F 2005/028; A41D 19/0089; A41D 13/0005
See application file for complete search history.

(56) References Cited

U.S. PATENT DOCUMENTS 312,085 A * 2/1885 Claghorn ..... A62B 1/14 224/663
775,149 A * 11/1904 Righton ..... A45F 5/02 224/195

(Continued)

FOREIGN PATENT DOCUMENTS

DK 9700289 9/1997
EP 1316262 6/2003

(Continued)

OTHER PUBLICATIONS https://www.projob.se/News-List/shorts/, New Wave Group,Advertisement for Projob Workwear AB, dated Jun. 11, 2019, 2 pages.

(Continued)

*Primary Examiner* — Alissa L Hoey
(74) *Attorney, Agent, or Firm* — Dinsmore & Shohl LLP

(57) ABSTRACT

A garment arrangement includes a garment having an elongated garment portion provided with at least one garment connection portion, and an attachment means configured to be releasably connected to said garment connection portion. The attachment means is configured to be movable along the extension of said elongated garment portion. A method is also provided.

18 Claims, 13 Drawing Sheets

(56) References Cited

U.S. PATENT DOCUMENTS 1,232,992 A * 7/1917 Stering ..... A42B 1/247 2/10
1,547,997 A 7/1925 Fagerstrom
2,855,604 A * 10/1958 Austin ..... A42B 3/227 2/171.1
3,698,045 A * 10/1972 Redden ..... E04H 15/64 24/DIG. 37
3,711,867 A 1/1973 Mott
4,231,135 A * 11/1980 Fradin ..... A47C 7/425 16/382
4,673,070 A * 6/1987 Ambal ..... A45C 7/0086 190/110
5,090,057 A * 2/1992 Aldridge ..... A62B 17/001 2/232
5,201,448 A * 4/1993 Schue ..... B25H 3/00 224/660
5,337,491 A * 8/1994 Mascotte ..... A43B 3/16 36/7.1 R
5,471,684 A * 12/1995 Casale ..... A42B 1/0184 2/10
5,632,071 A * 5/1997 Maunder ..... E04H 15/003 24/DIG. 37
5,715,534 A * 2/1998 Mobley ..... A42B 1/0184 2/10
5,722,576 A 3/1998 Rogers
5,815,843 A * 10/1998 Brillhart, III ..... A45F 5/02 190/110
5,881,933 A * 3/1999 Rogers ..... F41C 33/041 224/195
6,035,449 A 3/2000 Galler et al.
6,058,577 A * 5/2000 Ida ..... A45C 13/08 24/697.2
6,263,508 B1 * 7/2001 Davis ..... A42B 1/0184 2/10
6,283,345 B1 * 9/2001 Butschat ..... B44D 3/14 224/663
6,578,745 B1 * 6/2003 Taylor ..... A45F 5/021 224/669
6,611,964 B2 * 9/2003 Lipsett ..... A41D 1/06 2/69
6,726,075 B1 * 4/2004 Patel ..... A45F 3/14 224/582
6,839,917 B1 1/2005 Landwehr
6,848,605 B2 * 2/2005 Dillenberger ..... B25H 3/006 224/904
7,058,981 B2 * 6/2006 Clark ..... A41D 3/00 2/69
7,216,404 B1 * 5/2007 Doyle ..... F41C 33/041 24/104
7,231,671 B2 * 6/2007 Allen ..... A41D 1/06 2/232
7,240,373 B2 * 7/2007 Ahn ..... A42B 1/22 2/175.1
7,428,787 B2 * 9/2008 Crowley, II ..... A43B 7/12 36/100
7,448,115 B2 11/2008 Howell et al.
7,526,842 B2 * 5/2009 Wemmer ..... A41F 1/00 24/578.13
7,748,058 B2 * 7/2010 Steitle ..... A41D 27/08 2/232
7,762,440 B2 * 7/2010 Cook ..... A45F 5/021 224/660
8,028,351 B2 * 10/2011 Stachler ..... A62B 17/006 2/457
8,327,464 B2 * 12/2012 Jaros ..... A41F 1/00 2/243.1
8,453,267 B1 * 6/2013 Stanley ..... A41D 1/067 2/244
8,713,764 B1 * 5/2014 Rittenhouse ..... A45F 3/14 24/3.12
9,392,830 B2 * 7/2016 Simmons, Sr. ..... A41D 3/00
9,402,458 B2 * 8/2016 Kooyers ..... A45F 5/021
9,877,555 B1 * 1/2018 Tien ..... A45C 3/00
9,980,528 B2 * 5/2018 Reinhart ..... A42B 1/0184
10,172,399 B1 * 1/2019 Rivers ..... A41D 19/0024
10,219,569 B2 * 3/2019 Olivera, II ..... A42B 1/0184
10,362,825 B2 * 7/2019 Judge ..... A42B 1/0184
10,736,406 B2 * 8/2020 Hintze ..... A45F 5/021
10,757,993 B2 * 9/2020 Son ..... A42B 1/205
10,893,708 B1 * 1/2021 Burnsed, Jr. ..... A41D 1/04
10,918,195 B2 * 2/2021 Kooyers ..... A41F 1/008
11,058,187 B2 * 7/2021 Baschak ..... A41F 1/00
11,064,796 B1 * 7/2021 Blauer ..... F16B 5/0664
11,219,249 B2 * 1/2022 Brandy ..... A41F 1/00
11,490,696 B2 * 11/2022 Harris ..... A44B 19/32
12,004,604 B2 * 6/2024 Broce ..... A41D 1/00
2001/0044991 A1 * 11/2001 Graves ..... A44B 19/16 24/400
2004/0040067 A1 * 3/2004 Pong ..... A42B 1/22 2/195.2
2004/0065709 A1 4/2004 Dillenberger
2005/0120464 A1 6/2005 Clark
2006/0112596 A1 * 6/2006 Chan ..... A43B 3/122 36/11.5
2006/0162135 A1 7/2006 Howell et al.
2007/0017003 A1 * 1/2007 Harris ..... A42B 1/0184 2/195.1
2007/0163029 A1 7/2007 Burgess et al.
2007/0214547 A1 * 9/2007 Mullen ..... A41D 15/002 2/227
2007/0294806 A1 * 12/2007 Harazi ..... A41D 27/08 2/244
2010/0107298 A1 * 5/2010 Coole ..... A44B 13/00 2/243.1
2010/0170026 A1 * 7/2010 Jeffords ..... A41D 27/08 2/244
2010/0175168 A1 * 7/2010 Yari ..... A41D 1/06 2/244
2010/0199399 A1 * 8/2010 Garza ..... A41D 15/002 2/24
2013/0219582 A1 * 8/2013 Harris, III ..... A41D 3/00 2/79
2013/0320053 A1 * 12/2013 Kim ..... A45F 3/04 224/195
2014/0166516 A1 6/2014 Martinez
2015/0033446 A1 2/2015 Kanayama
2016/0345642 A1 12/2016 Brothers
2018/0279749 A1 10/2018 Quillmann
2019/0053612 A1 2/2019 Santini
2019/0281963 A1 9/2019 Trent
2019/0328060 A1 * 10/2019 Frazzini ..... A41F 5/00
2020/0025512 A1 * 1/2020 Ray ..... A45F 5/021
2021/0196007 A1 * 7/2021 Haugen ..... A41D 13/0005
2021/0251372 A1 * 8/2021 Chu ..... A45F 5/021
2022/0042764 A1 * 2/2022 Ray ..... F41C 23/20
2022/0045458 A1 * 2/2022 Wu ..... F16B 5/0657

FOREIGN PATENT DOCUMENTS

EP 1654942 5/2006
GB 2165737 B 4/1988
GB 2264039 B 4/1996
WO 03/096839 A1 11/2003
WO 2010146093 A2 12/2010
WO 2017177255 A1 10/2017

OTHER PUBLICATIONS

Catalog—What Works in Sweden Workwear Collection 2019, Projob Swedish Workwear, "Portion of Catalog including a closeup view of a portion of one page", 6 pages.

* cited by examiner

GARMENT WITH ADJUSTABLE ATTACHMENT SYSTEM

CROSS-REFERENCE TO RELATED APPLICATIONS

This application is the U.S. National Stage of PCT/SE2021/050133 filed on Feb. 17, 2021, which claims priority to Sweden Patent Application 2050181-3 filed on Feb. 18, 2020, the entire content of both are incorporated herein by reference in their entirety.

FIELD OF THE INVENTION

The invention relates to a garment arrangement, and a method connecting at least one attachment means to a garment arrangement.

BACKGROUND OF THE INVENTION

Craftsmen in different technical fields, for instance carpenters, often use work wear and protective garments during labour to prevent the occurrence of injuries and to have easy access to different tools and working gear. Such work wear include among others carpenter trousers and work wear jackets.

Typically, a work wear trouser comprises several loops and pockets, to support and hold such tools and/or gear. Some work wear are modular, such that pockets and protective knee pads may be detachable from the trouser using zippers or hook-and-loop fasteners. An example of such carpenter trouser is disclosed in EP1316262A1. However, such trousers lack holding devices for large and heavy instruments and there is often a need for more pockets with variable sizes and of different types than those present in a carpenter trouser.

Therefore, many craftsmen use tool belts, provided with more robust tool holding devices, such as the belts disclosed in US20040065709A1 or US20140166516A1. Preferably such belts have tool holders which may be adjustable along the extension of the belt. However, such belt has the disadvantage that the belt has to be worn on the outside of a work trouser and the belt may slide around the waist of the user due to uneven loading or different weight of the tools held in the belt. Further, these belts are often adapted after the craftsmen in need of most equipment, rendering the tool belt unnecessarily bulky and ungainly for several users. In addition, the tool holders themselves may move along the belt when the craftsman is working.

A third option is to attach a tool holder to an ordinary belt threaded through belt loops, and then fasten the instrument to the tool holder. However, with this solution, the belt loops of the trousers may be in the way when the user wishes to adjust the position of the tools/instruments fastened along a belt passed through the belt loops.

Hence, there is a need for an improved work wear which overcome these problems.

SUMMARY OF THE INVENTION

According to a first aspect of the invention, the above and other objects of the invention are achieved, in full or at least in part, by a garment arrangement as disclosed herein. The above object is achieved by a garment arrangement, comprising a garment having an elongated garment portion provided with at least one garment connection portion, and an attachment means configured to be releasably connected to the garment connection portion. The attachment means is configured to be movable along the extension of the elongated garment portion. The garment connection portion further comprises a projecting part extending from the elongated garment portion. The garment connection portion may further comprise a connection element being arranged at a remote end of the projecting part. This is advantageous in that it will cause the attachment means to be arranged at a preferable position when the attachment means is connected to the garment connection portion.

According to a first embodiment, the garment arrangement further comprises a gear holding device and the attachment means is configured to be connected to the gear holding device. Preferably the attachment means is connected to the gear holding device by screws, bolts, rivets, stitches or an adhesive. This is beneficial since the attachment means provides flexibility for the user to choose different number of attachment means and thus different types or number of gear holding devices. Various numbers of attachment means may be used, and the user can adapt the number and type of gear holding device depending on present needs. Each gear holding device may in turn be fastened using one or several attachment means, which make the gear holding device securely releasably attachable to the garment. Preferably, the connection element is in the form of a rail. Further optionally, the connection element is configured to slidingly and releasably engage an attachment member of the attachment means. In one embodiment, the attachment member is a clutch with a clutch cavity and a clutch opening. The clutch opening is configured to hold the connection element, which may be inserted in the clutch through the clutch opening.

According to a second embodiment, the gear holding device is connected to the attachment means through a mating fixation part engaging a fixation end of the attachment means. Preferably, the mating fixation part is connected to the gear holding device by screws, bolts, rivets, stitches or an adhesive. This is advantageous in that the attachment means can be left connected to the elongated garment portion when the gear holding device is removed.

According to another embodiment, the gear holding device is a tool holder, a loop, a pocket or an advanced pocket having a plurality of sub-pockets, loops and/or tool holders. This is beneficial since it may provide the garment with different sorts of instrument holders such that the garment becomes modular and can be adapted to various uses.

According to yet another embodiment, the elongated garment portion is arranged and extends along a width W of the garment. Preferably, the elongated garment portion is arranged and extends along a waistband of the garment.

According to another embodiment, the connection element is in the form of a rail and the attachment means comprises an attachment member configured to releasably slidingly engage the rail. This is beneficial since the attachment member can be threaded onto the rail sideways and slide along the rail and be arranged at a position which is preferred by the user.

According to another embodiment, the rail has a substantially circular cross-section.

According to one embodiment, the rail has a substantially rectangular cross-section.

According to yet another embodiment, the attachment member is a type of clutch, having a clutch opening and a clutch cavity.

According to another embodiment, the garment connection portion and parts thereof are made of textile parts.

Preferably, the garment connection portion is made of a material comprising nylon. This is advantageous since such materials can provide high strength and are durable and can resist wear. In addition, they may provide a surface structure that causes friction between the attachment member and the textile such that the attachment means will be movable along the garment connection portion but undesirable sliding along the garment connection portion and the elongated garment portion is prevented.

According to yet another embodiment, the garment is a trouser or a jacket.

According to yet another embodiment, the garment is a work wear garment. This is advantageous since the garment arrangement provides the work wear garment with a broad flexibility in terms of adapting the work wear for different craftsmen and different uses.

According to a second aspect, there is provided a method for connecting at least one attachment means to an elongated garment portion of a garment arrangement. The method comprises the steps of providing a garment having an elongated garment portion provided with at least one garment connection portion, providing the attachment means, releasably connecting the attachment means to the garment connection portion, and adjusting the attachment means to a preferred position along the garment connection portion. The garment connection portion further comprises a projecting part extending from the elongated garment portion and a connection element being arranged at a remote end of the projecting part.

In one embodiment, the method further comprises the step of connecting a mating fixation part to a fixation end of said attachment means. The fixation part is connected to a gear holding device.

In another embodiment, the method further comprises a step of putting on the work wear garment before the steps of releasably connecting the attachment means to the garment connection portion and adjusting the attachment means to a preferred position along the garment connection portion.

In one embodiment, the step of connecting the mating fixation part to the fixation end of said attachment means is conducted before the step of adjusting the attachment means to a preferred position along the garment connection portion.

In one aspect, there is provided a garment arrangement, comprising a garment, a strap provided with at least one strap connection portion and being at least partly integrated within the garment, and an attachment means configured to be releasably connected to the strap connection portion. The attachment means is configured to be movable along the extension of the strap.

In another aspect, there is provided a method for connecting a strap to at least one attachment means of a garment arrangement. The method comprises providing the strap provided with at least one strap connection portion. The strap is at least partly integrated within a garment. The method further comprises providing the attachment means and releasably connecting the attachment means to the strap connection portion, and adjusting the attachment means to a preferred position along the strap.

In yet one aspect, there is provided an attachment means comprising an attachment member configured to releasably connect the attachment member to a garment connection portion, wherein said attachment means is configured to be movable along the extension of an elongated garment portion. The attachment member may be a type of clutch having a clutch opening and a clutch cavity.

In yet one further aspect, there is provided a garment having an elongated garment portion provided with at least one garment connection portion, said garment connection portion configured to be releasably connected to an attachment means, and wherein said garment connection portion further comprises a projecting part extending from said elongated garment portion and a connection element being arranged at a remote end of said projecting part. Other objectives, features and advantages of the present invention will appear from the following detailed disclosure, as well as from the drawings. It is noted that the invention relates to all possible combinations of features.

Generally, all terms used herein are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

As used herein, the term "comprising" and variations of this term are not intended to exclude other additives, components, integers or steps.

BRIEF DESCRIPTION OF THE DRAWINGS

By way of example, embodiments of the present invention will now be described with reference to the accompanying drawings, in which.

DETAILED DESCRIPTION OF THE EMBODIMENTS

Embodiments of the present invention will be described in more detail below with reference to the accompanying drawings in order for those skilled in the art to be able to carry out the invention. The invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments do not limit the invention, but the invention is only limited by the appended patent claims. Furthermore, the terminology used in the detailed description of the particular embodiments illustrated in the accompanying drawings is not intended to be limiting of the invention.

Embodiments of the present invention will now be described below with reference to FIGS. 1*a* to 8*c*.

The present disclosure relates to garment arrangements in particular trousers and jackets, comprising a connection system 1000, 2000 (shown in FIGS. 1*d*, 3*b*, 6*b* and 7*b*) for releasably attachable tool holders and pockets, or any other feature desirable for a garment, for instance protective gear such as knee or elbow pads. The connection system 1000, 2000 is also referred to as a garment arrangement 1000, 2000 or a releasable adjustable attachment system 1000, 2000 herein. The garments may be for instance a work wear garment or a sportswear garment. Work wear may relate to wear worn by for instance craftsmen, construction builders, carpenters, industry workers, fire fighters, police officers, plumbers, different kind of guards etc. It may be indoor wear or outdoor wear.

Figures 1A, 1B, 1C:
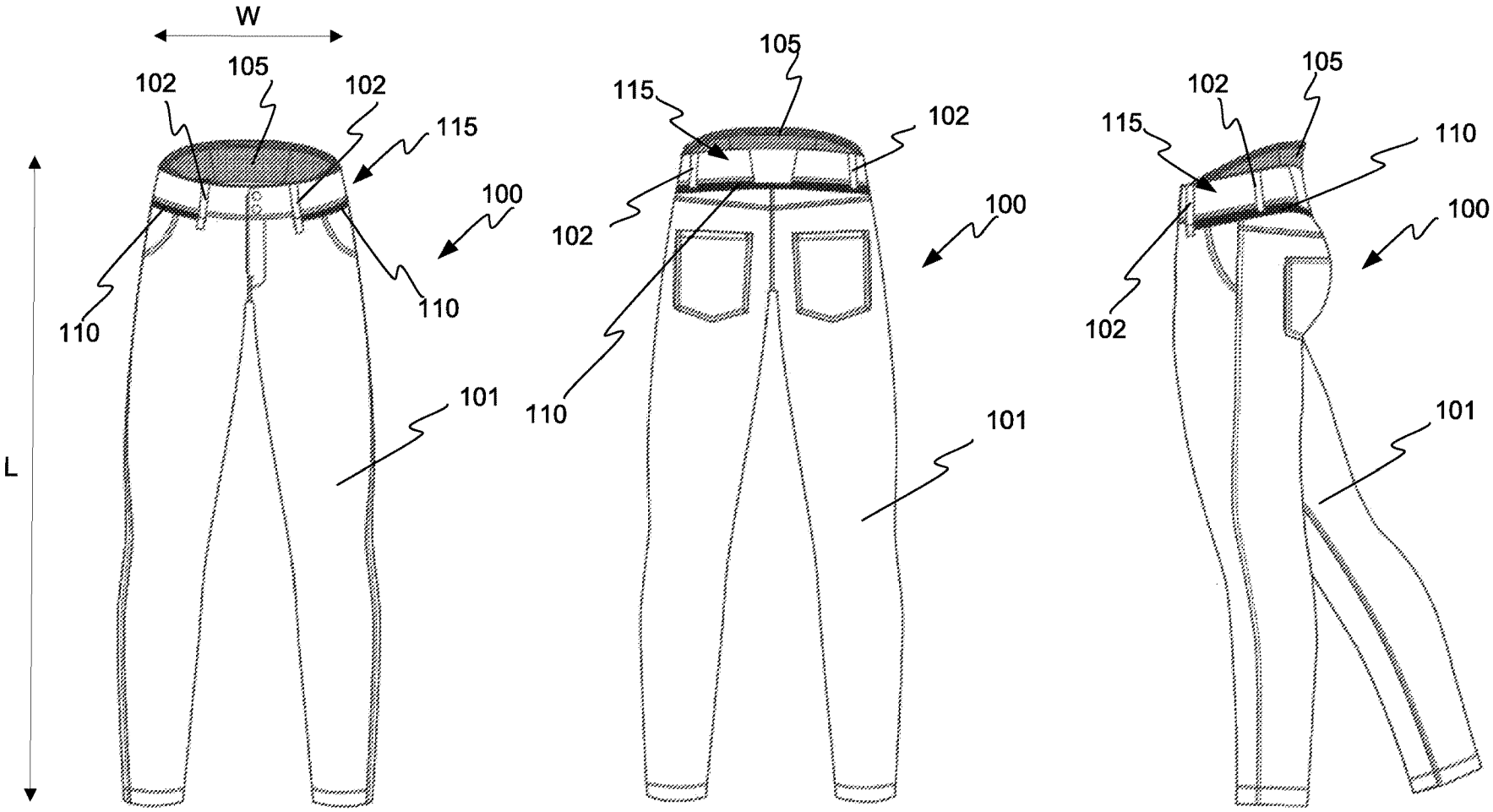
FIGS. 1*a-c* shows a work wear trouser in a front view, a rear view and a side view, respectively.

With reference to FIGS. 1*a*-1*d* and FIGS. 2*a-c*, work wear garments 100, 200 are shown. FIGS. 1*a-c* show a trouser 100 having a pair of legs 101, a plurality of belt loops 102 and a waist fabric mesh 105. The trouser 100 has a width W extending along a lateral direction, whereas the legs 101 have a length L extending in a longitudinal direction indicated by the arrow in FIG. 1*a*.

In addition, the trouser 100 in FIGS. 1*a-d* comprises an elongated garment portion 110. The elongated garment portion 110 extends laterally around and along a waistband 115 of said trouser 100. FIG. 1*a* shows a front view of the trouser 100, FIG. 1*b* shows a rear view of the trouser 100 and FIG. 1*c* shows a side view of the trouser 100. The trouser 100 may also comprise a plurality of separate elongated garment portions 110 portioned along the waistband 115, or arranged elsewhere on the trousers 100, such as for instance in the thigh area, around the knees or in the area by the calves.

Figure 1D:
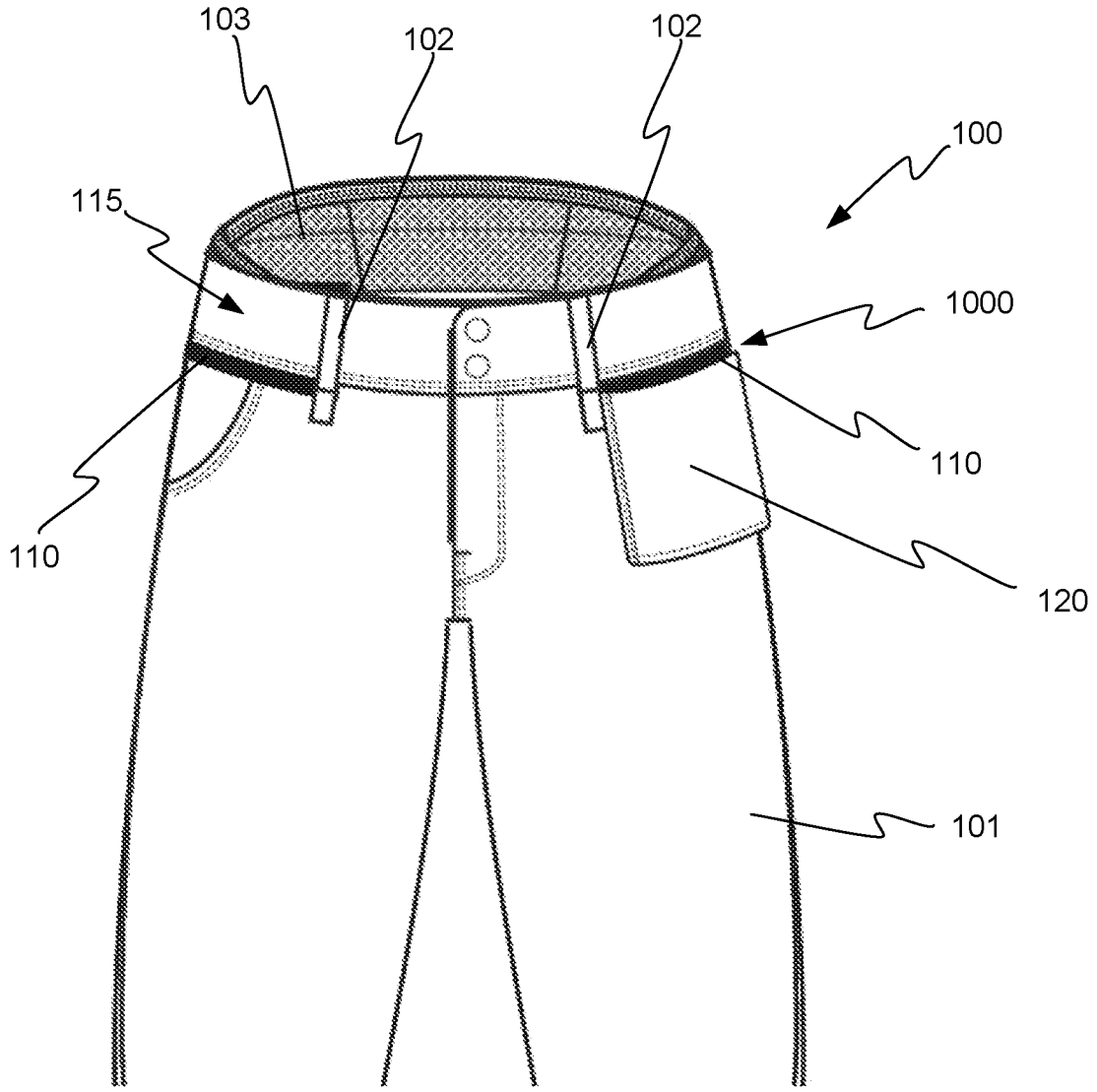
FIG. 1*d* shows a portion of the work wear trouser shown in FIGS. 1*a-c* having a pocket releasably attached thereto.

In FIG. 1*d*, a gear holding device 120 has been releasably attached to the elongated garment portion 110. In this Figure, the gear holding device 120 is a pocket. However, the gear holding device 120 may be another type of device, such as a tool holder, a loop, an advanced tool pocket having a plurality of smaller pockets, loops and/or tool holders integrated therein, or any other instrument holder useful for a user. The connection system 1000 between the elongated garment portion 110 and the gear holding device 120 will be explained in more detail with reference to FIGS. 3*a*-7*b*.

Figures 2A, 2B, 2C:
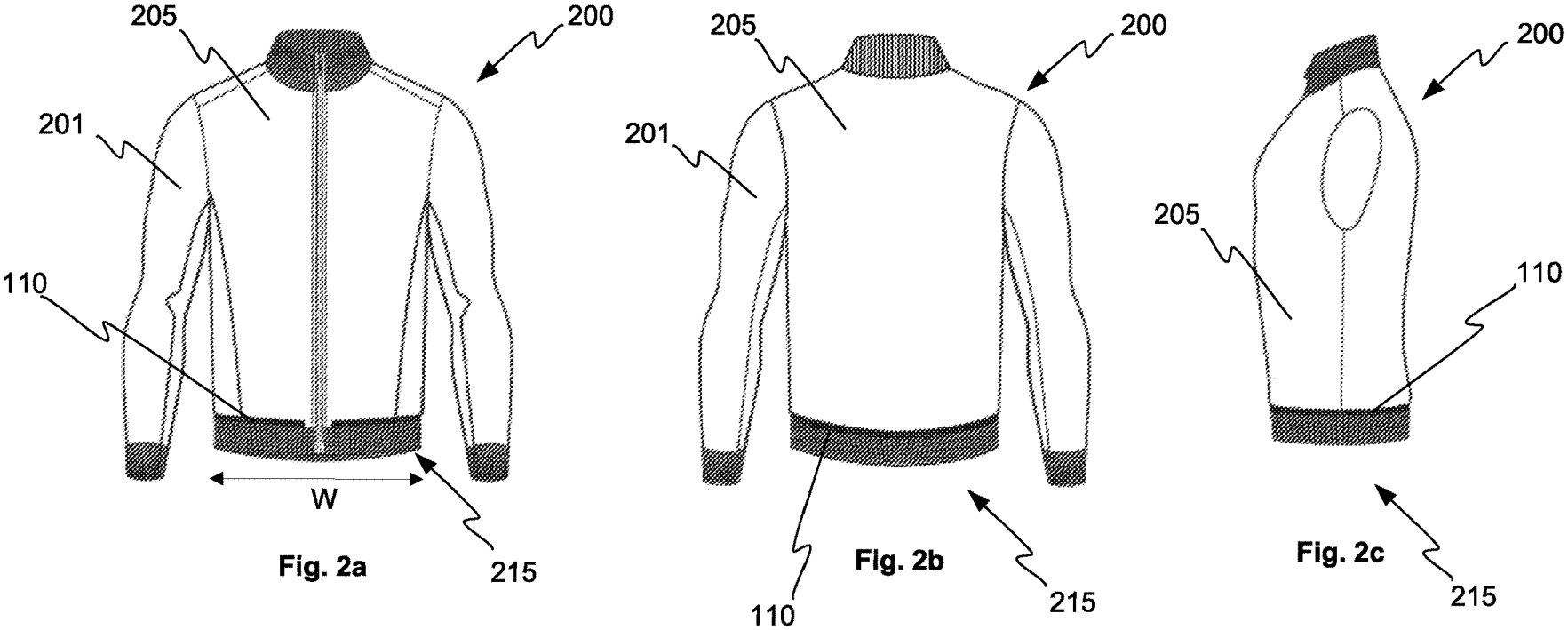
FIG. 2*a-c* shows a work wear jacket in a front view, a rear view and a side view respectively.

FIGS. 2*a-c* show a jacket 200 comprising two arms 201, a torso portion 205 and a waistband 215. An elongated garment portion 110 of the same configuration as the elongated garment portion 110 shown in FIGS. 1*a-d* is also comprised in the jacket 200 along a width W of the waistband 115. Said width W is indicated by the arrow in FIG. 2*a*. The elongated garment portion 110 extends laterally around and along the waistband 115, wherein the extension of the elongated garment portion 110 along and around the waistband 115 defines a waistband direction. Similarly to the trouser 100, the elongated garment portion 110 is configured to receive and releasably connect a gear holding device 120 as shown in FIGS. 1*d* and 5*b*.

Figure 3A:
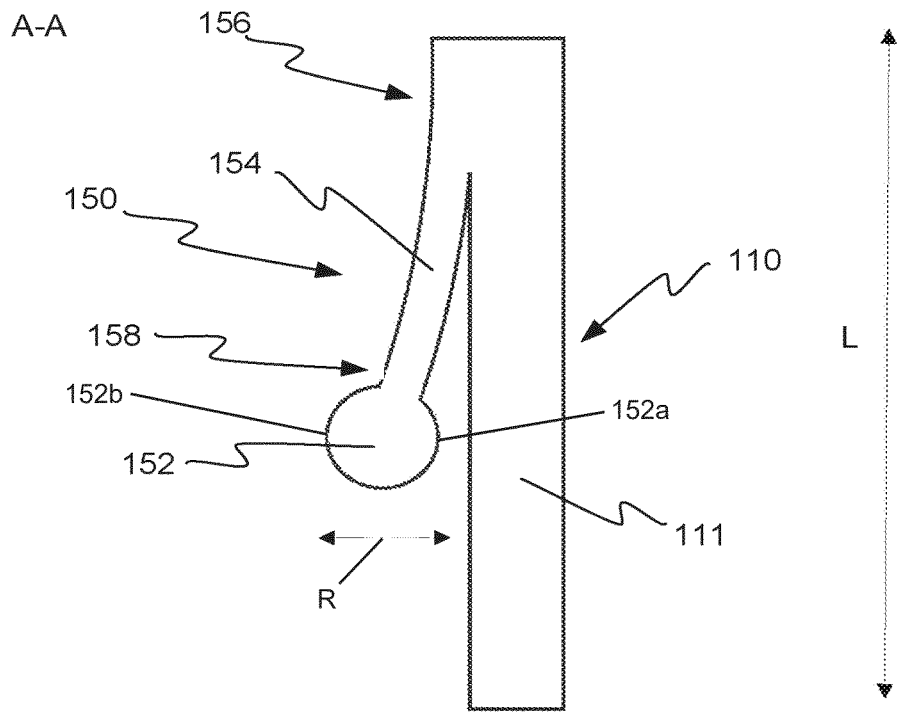
FIG. 3*a* shows a longitudinal cross-section of an elongated garment portion comprising a connection portion disclosed herein.

An enlarged view of a longitudinal cross-section A-A (indicated in FIG. 4*b*) of the elongated garment portion 110 is shown in FIG. 3*a*. The longitudinal direction L is indicated by a double-faced arrow in FIG. 3*a*. The cross-section A-A is taken perpendicularly to the longitudinal direction L and the width W (shown in FIG. 4*b*).

Figure 3B:
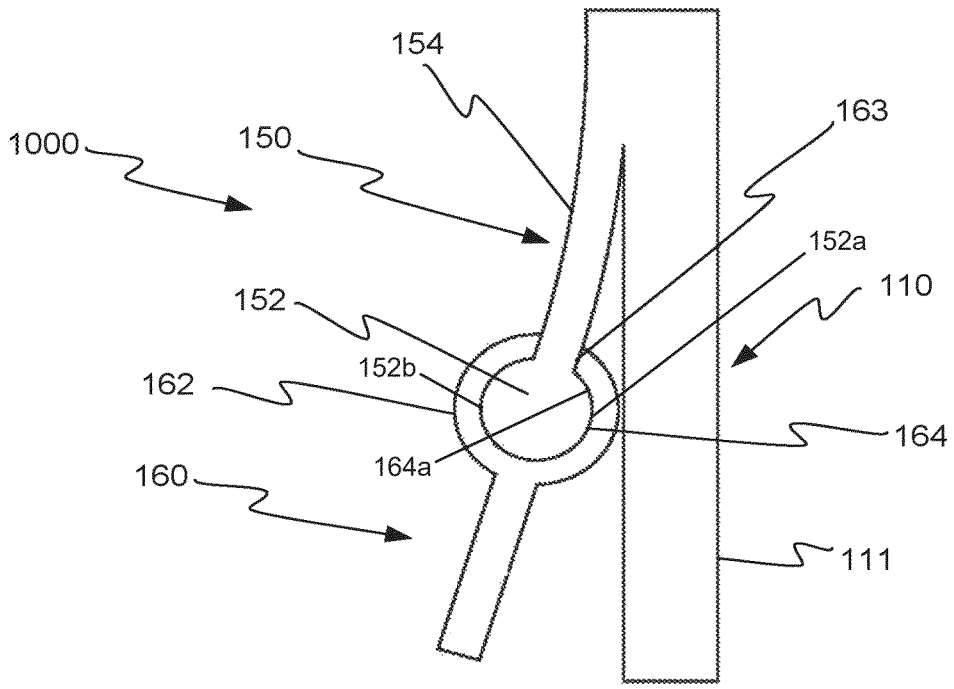
FIG. 3*b* shows the longitudinal cross-section of an elongated garment portion comprising the connection portion of FIG. 3*a*, having an attachment means releasably connected thereto.

The elongated garment portion 110 comprises a garment connection portion 150, which in turn comprises a connection element 152 and a projecting part 154 extending from a base 111 of the elongated garment portion 110. The projecting part 154 is in the form of a strap or flange 154 having an adjacent end 156 and a remote end 158. The projecting part 154 shown in FIGS. 3*a* and 3*b* is movable towards and away from the base 111 as indicated by the double-faced arrow in FIG. 3*a* placed below the connection element 152. The connection element 152 is in the form of a rail 152 in FIGS. 3*a* and 3*b*, the rail 152 comprising: an inward facing surface 152*a* that faces toward the base 111 along a radial direction R that is perpendicular to both the waistband direction (i.e., a direction that is normal to the page in FIG. 3*a*) and the longitudinal direction L of the garment; and an outward facing surface 152*b* that faces away from the base 111 along the radial direction R that is perpendicular to both the waistband direction and the longitudinal direction L of the garment. As shown in FIG. 3*b*, in embodiments, both the inward facing surface 152*a* of the rail 152 and the outward facing surface 152*b* of the rail 152 are in contact with an inner surface 164*a* of the clutch cavity 164 when said attachment member 160 is releasably slidingly engaged with said rail 152.

In FIG. 3*b*, an attachment means 160 has been releasably connected to the connection element 152 and the parts form a releasable adjustable attachment system 1000. The attachment means 160 comprises an attachment member 162, which in FIG. 3*b* is in the form of a clutch 162. The clutch 162 detachably engages the connection element 152. The connection element 152 has been threaded into a cavity 164 of the clutch 162 through a clutch opening 163.

Figure 4A:
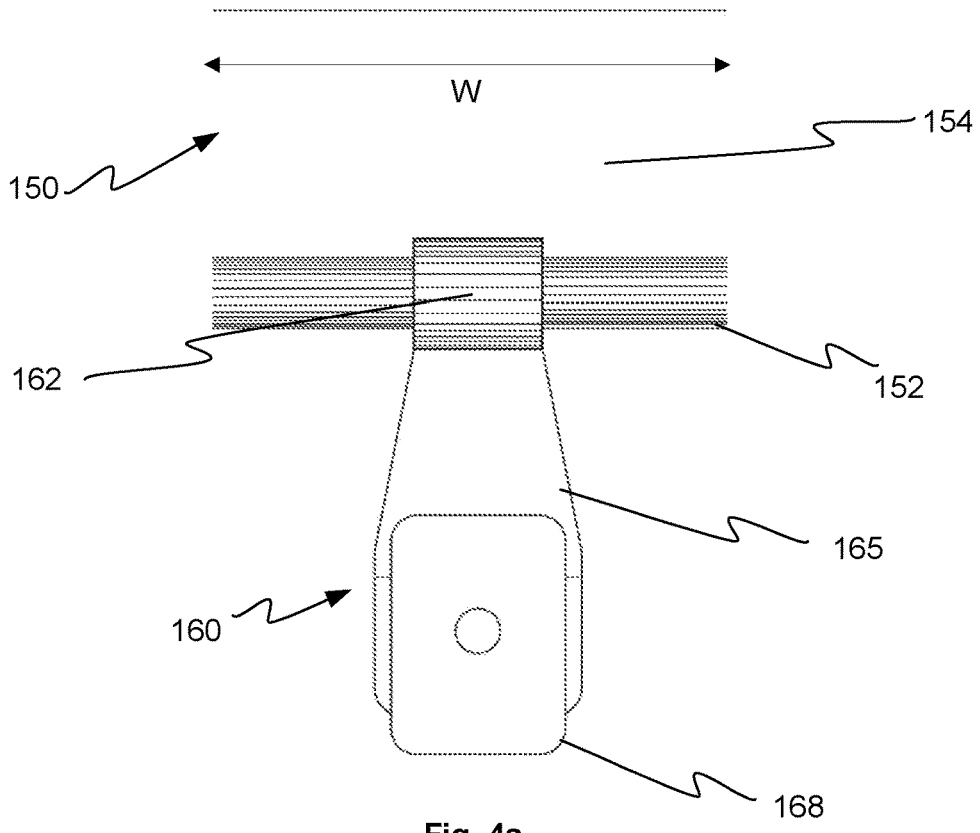
FIG. 4*a* shows a front view of the elongated garment portion having an attachment means releasably connected thereto shown in FIG. 3*b;*
Figure 4B:
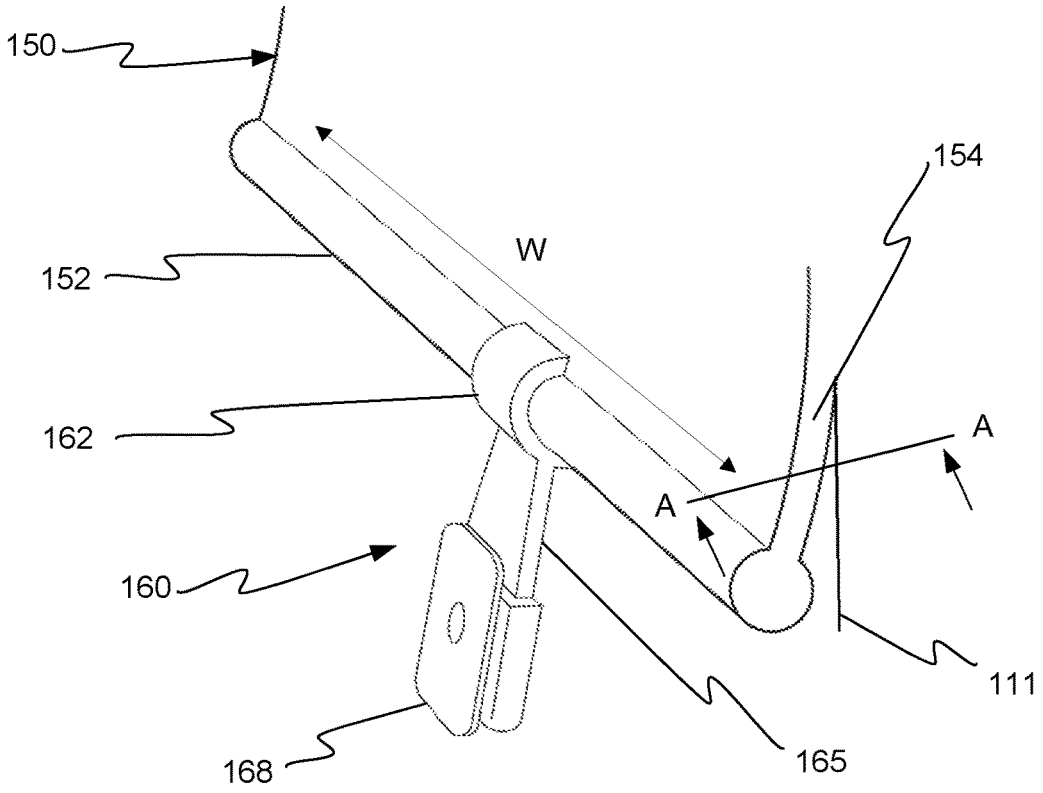
FIG. 4*b* shows an isometric view of the elongated garment portion having an attachment means releasably connected thereto shown in FIG. 3*b;*
Figure 8A:
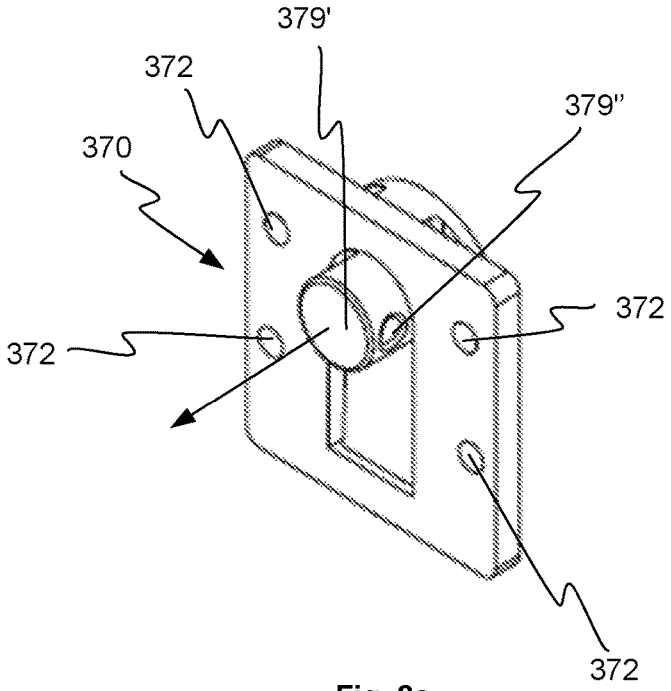
FIGS. 8*a-d* show an attachment means, and a mating fixation part.
Figure 8B:
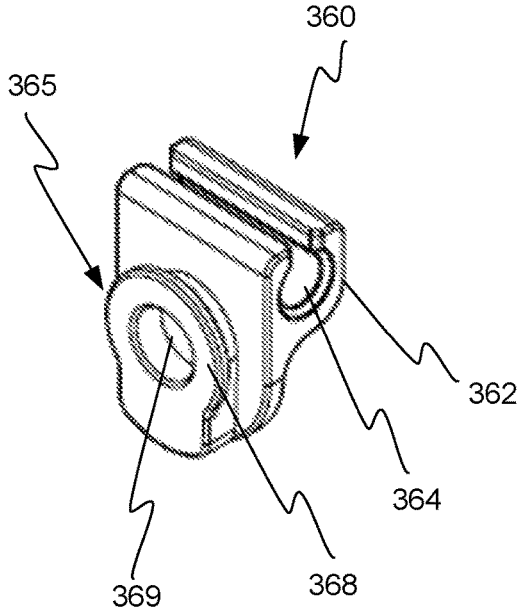
Figure 8C:
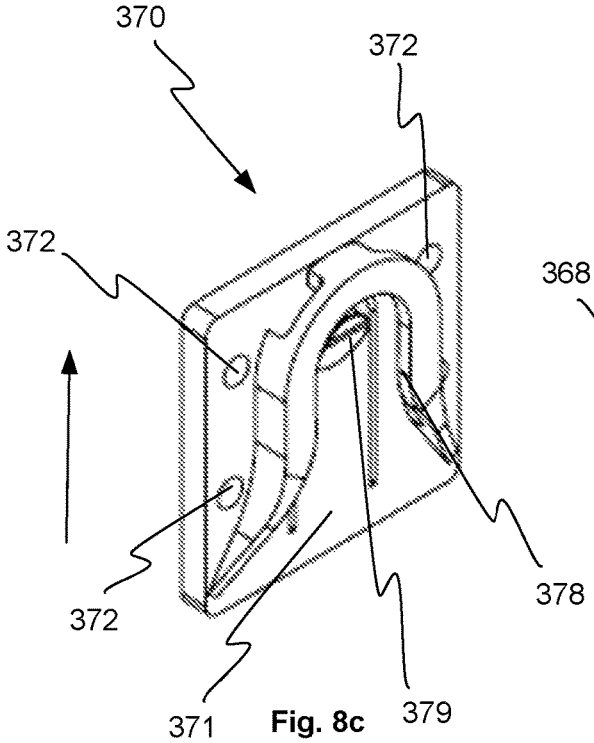

FIG. 4*a* shows the connection mechanism shown in FIGS. 3*a* and 3*b* in a front view. FIG. 4*b* shows an isometric view of the connection mechanism shown in FIGS. 3*a*-4*a*. The attachment means 160 comprises the clutch 162, which is releasably attached to the rail 152, arranged on the projecting part 154 of the garment connection portion 150. From the clutch 162 extends an attachment portion 165, which has a fixation end 168 configured to either be attached to a mating fixation part (for instance as shown in FIGS. 8*a*-8*c*) or being directly attached to the gear holding device 120 (as shown in FIG. 1*d* or 5*b*), for instance by screws, rivet and/or by the use of an adhesive or sowing.

Figure 5A:
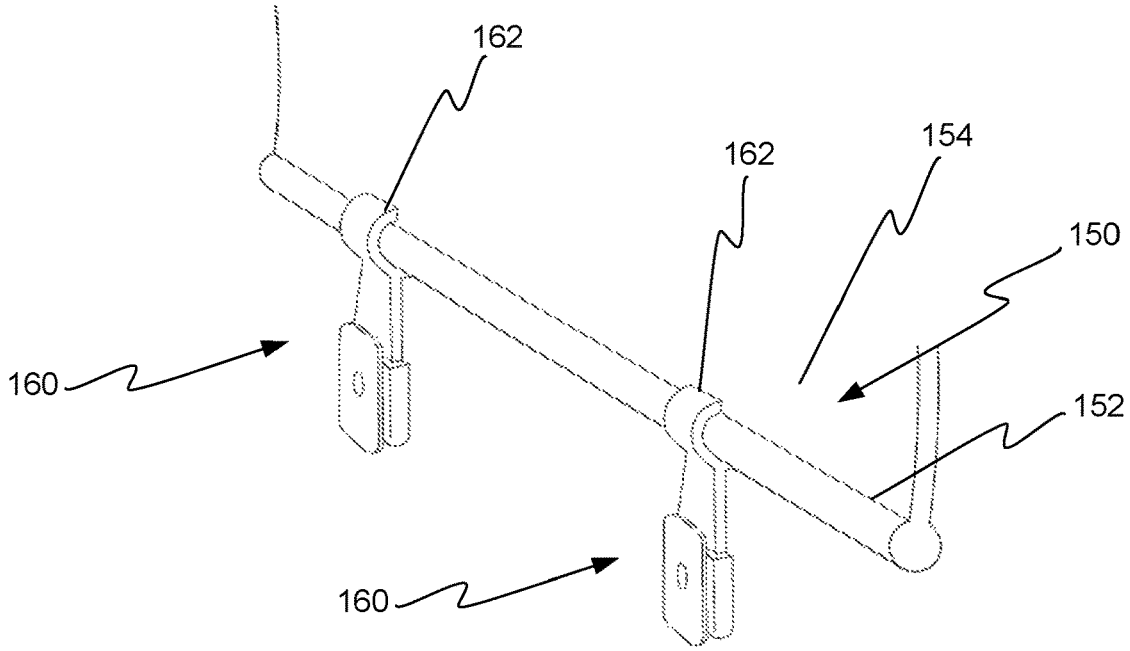
FIG. 5*a* shows an isometric view of the elongated garment portion having two attachment means releasably connected thereto.
Figure 5B:
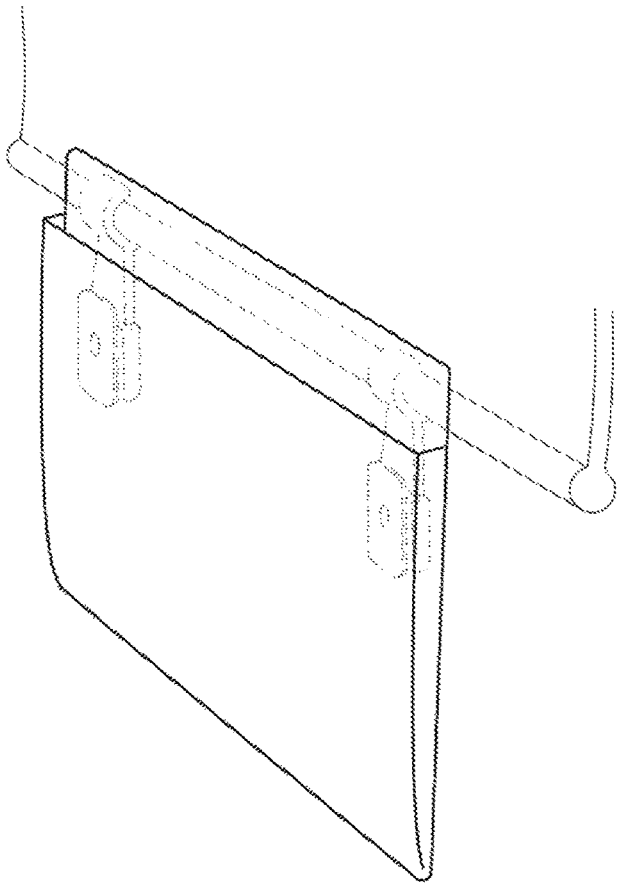
FIG. 5*b* shows an isometric view of the elongated garment portion having two attachment means releasably connected thereto being connected to a pocket.

In FIG. 5*a*, two attachment means 160 have been releasably coupled to the connection element 152 of the elongated garment portion 110 (the base 111 is not visible in the FIG. 5*a* as the projecting part 154 covers the base 111). Two attachment means 160 is beneficial to use for larger and/or broader gear holding devices 120, such as the pocket shown in FIG. 5*b*. The attachment means 160 have been adjusted along the extension of the rail 152 to fit the pocket 120, which has been attached to the attachment means 160.

The connection system 1000 shown in FIGS. 3*a*-5*b* has several advantages. First of all, the connection system of FIGS. 3*a* to 5*b* is slender against the trouser 100 or jacket 200. This is due to the design of the rail 152 and the flange 154 which prevents the formation of a certain thickness. In addition, the attachment means 160 may be designed to be thinner since the connection portion 150 in the trouser 100 will be arranged above (in a longitudinal direction) the attachment means 160 of the gear holding device 120.

The longitudinal position on the trouser 100 is also beneficial, since it is arranged just below the waistband 115, which enables the use of an ordinary belt if needed, and the pocket 120 will be arranged in a favourable position.

Figure 6A:
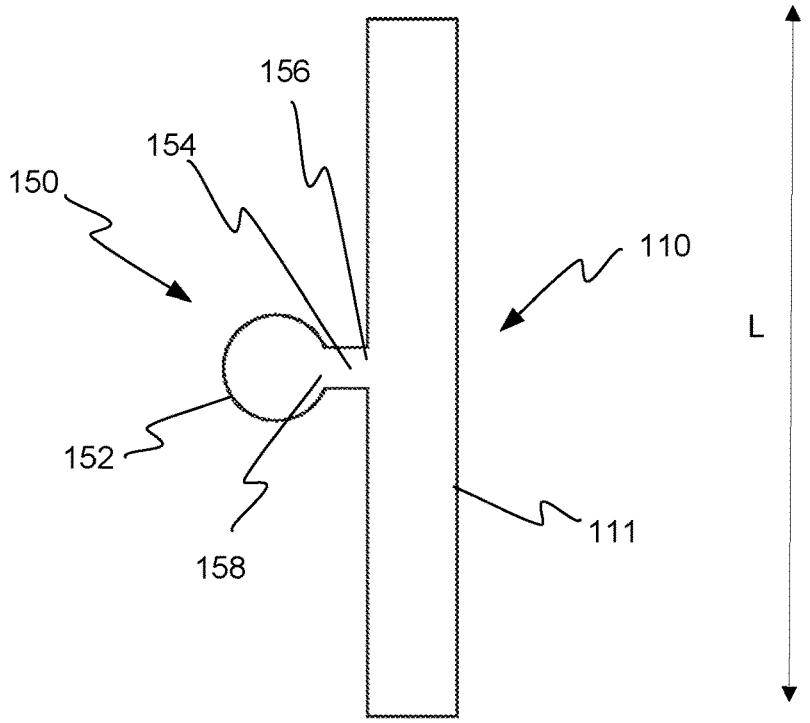
FIG. 6*a* shows a longitudinal cross-section of an elongated garment portion of another embodiment comprising a connection portion disclosed herein.
Figure 6B:
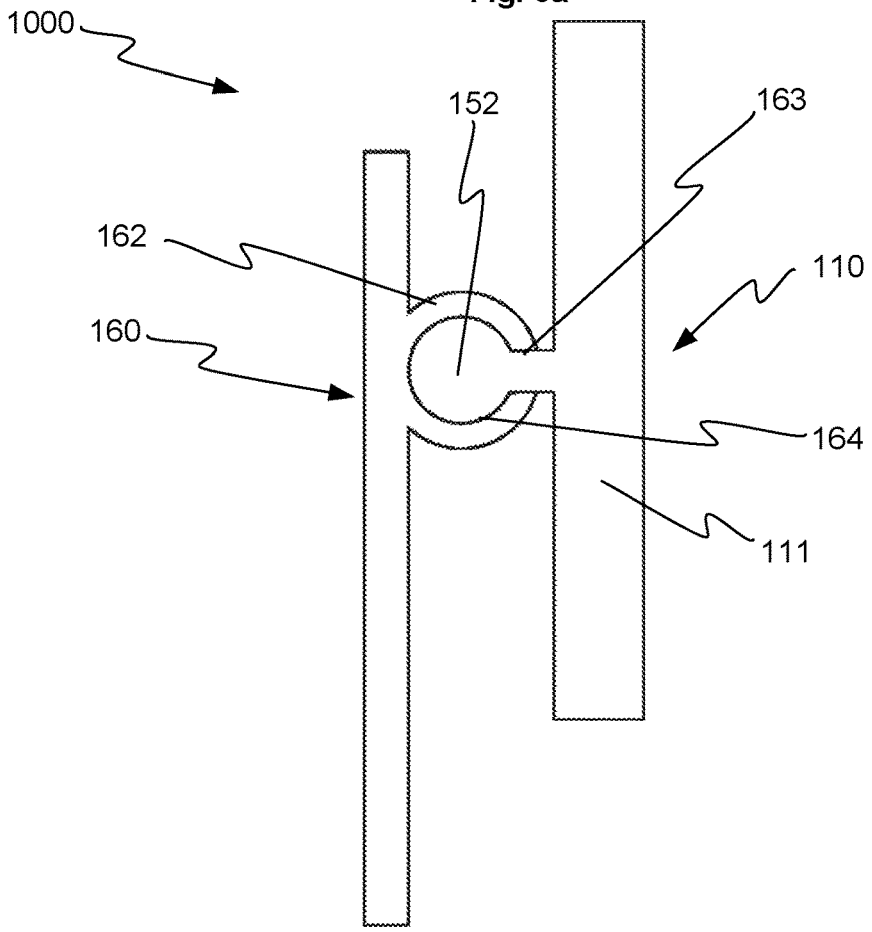
FIG. 6*b* shows the longitudinal cross-section of the elongated garment portion comprising the connection portion of FIG. 6*a*, having an attachment means releasably connected thereto.

With reference to FIGS. 6*a* and 6*b*, a different version of the releasable adjustable attachment system 1000 is shown. An enlarged view of a longitudinal cross-section of the elongated garment portion 110 is shown in FIG. 6*a*. The longitudinal direction L is indicated by the double-faced arrow in FIG. 6*a*.

The elongated garment portion 110 comprises a garment connection portion 150, which in turn comprises a connection element 152 and a projecting part 154 extending from a base 111 of the elongated garment portion 110. The projecting part 154 is in the form of a protrusion 154 having an adjacent end 156 and a remote end 158.

In FIG. 6*b*, an attachment means 160 has been releasably connected to the connection element 152. The attachment means 160 comprises an attachment member 162, which in FIG. 6*b* is, similarly to the attachment member of FIG. 3*b*, in the form of a clutch 162. The clutch 162 detachably engages the connection element 152. The connection element 152 has been threaded into a cavity 164 of the clutch 162 through a clutch opening 163.

The connection element 152 of FIGS. 3*a*-6*b* is in the form of a rail 152 extending laterally along the elongated garment portion 110. The rail 152 has a substantially circular cross-section. However, the cross-section shape of such connection element 152 may be in another geometrical shape enabling the releasable connection of the attachment means 160 to the connection element 152.

Figure 7A:
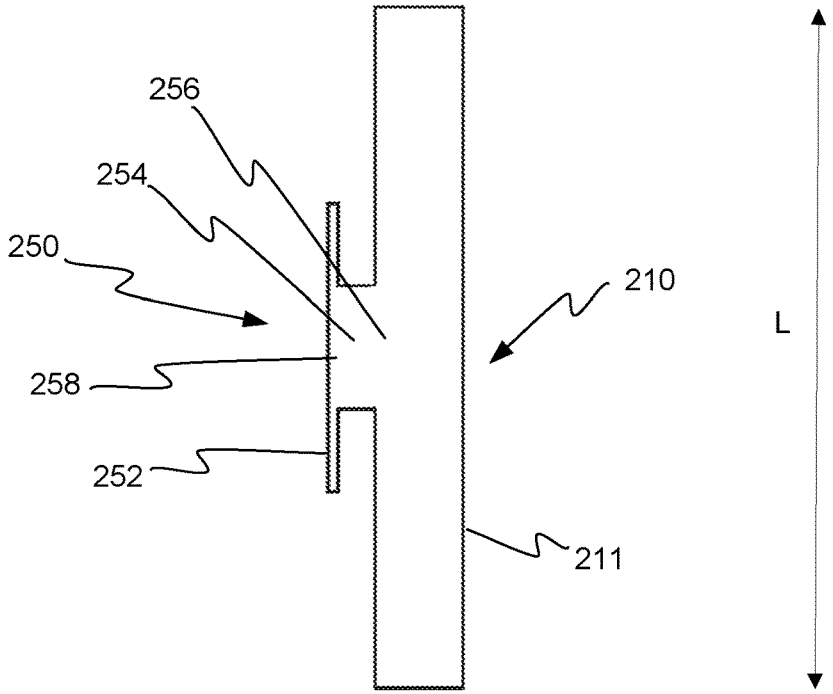
FIG. 7*a* shows a longitudinal cross-section of an elongated garment portion of yet another embodiment comprising a connection portion disclosed herein.
Figure 7B:
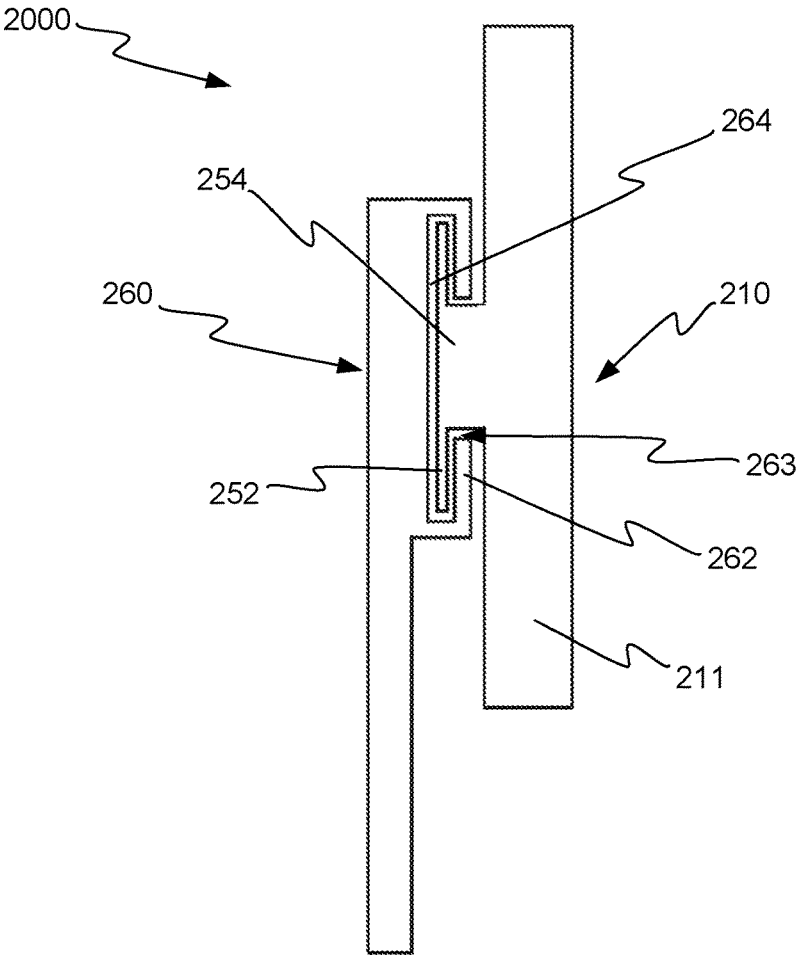
FIG. 7*b* shows the longitudinal cross-section of the elongated garment portion comprising the connection portion of FIG. 7*a*, having an attachment means releasably connected thereto.

A garment connection portion 250 of another embodiment is shown in FIGS. 7*a* and 7*b* as an enlarged longitudinal cross-section. The longitudinal direction L is indicated by the double-faced arrow in FIG. 7*a*. The elongated garment portion 210 comprises the connection portion 250 which is provided with a projecting part 254 and a connection element 252, which is in the form of a plate like member 252. The projecting part 254 extends from a base 211 of the elongated garment portion 210. The projecting part 254 is in the form of a block 254 having an adjacent end 256 and a remote end 258. The garment connection portion 250 is a type of rail extending laterally along the elongated garment portion 210, and has a rectangular longitudinal cross-section.

In FIG. 7*b*, an attachment means 260 has been releasably connected to the plate like member 252 and together form a releasable adjustable attachment system 2000, also referred to as a garment arrangement 2000 herein. The attachment means 260 comprises an attachment member 262, which in FIG. 7*b* is in the form of a clutch 262 having a rectangular cross-section. The clutch 262 detachably engages the connection element 252, in the form of the plate like member 252. The connection element 252 has been threaded into a cavity 264 of the clutch 262 through a clutch opening 263.

The fixation end 168, 268, 368 may comprise a magnet to improve the connection properties between the attachment means 160, 260 and the gear holding device 120. Further, the fastening between the fixation end 168, 268, 368 and a mating fixation part (shown in FIGS. 8*a*-8*c*) or a gear holding device 120 may be in the form of a known coupling mechanism known in the art, or such as a fastening mechanism disclosed with reference to FIGS. 8*a* and 8*b*.

Alternatively, the attachment means 160, 260 is connected directly to the gear holding device 120. In such case, the attachment means 160, 260 may be sown or glued to the gear holding device 120. Preferably, the attachment means 160, 260 connected directly to the gear holding device 120 is attached for instance by screws, an adhesive, stitches, rivets and/or vulcanization.

The releasable adjustable attachment systems 1000, 2000 shown in FIGS. 6*b* and 7*b* may further comprise an attachment portion 165, 265 and which has a fixation end 168 configured to either be attached to a mating fixation part (as for instance shown in FIGS. 8*a*-8*c*) or being directly attached to a gear holding device 120 as described with reference to FIGS. 4*a* and 4*b*. If the gear holding device 120 is attached to a mating fixation part 370 (shown in FIG. 8*a*), the gear holding device 120 may be connected to the mating fixation part 370 for instance by screws, bolts, screw-nuts, an adhesive, stitches, rivets or vulcanization. The gear holding device 120 could further be connected to the mating fixation part 370 using a plurality of the above attachment means, for example a combination of adhesive and stitches.

Figure 8D:
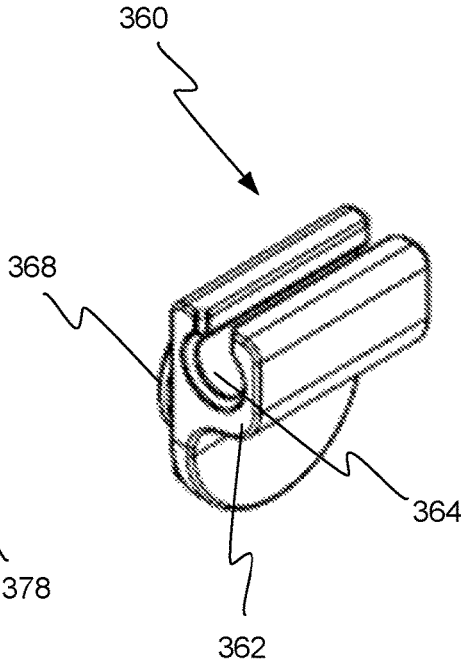

An example of a fastening mechanism between a mating fixation part 370 and an exemplary attachment means 360 is shown in FIGS. 8*a* to 8*d*. The attachment means 360 shown in FIGS. 8*b* and 8*d* is provided with (similarly to the attachments devices 160, 260 shown in FIGS. 3*a* to 7*b*) a clutch 362 having a cavity 364. The clutch 362 is configured to engage and hold a connection element 152, 252 of a elongated garment portion 110, 210. Further, the attachment means 360 comprises a locking recess 369 arranged on a fixation end 368 of an attachment portion 365.

The mating fixation part 370 in FIG. 8*a* is facing the attachment means 360 in FIG. 8*b* in the configuration which they fit together. The same applies for the mating fixation part 370 in FIG. 8*c* which faces the attachment means 360 in FIG. 8*d*.

The mating fixation part 370 shown in FIGS. 8*a* and 8*c* is provided with holes 372 which can be used to fasten the fixation part 370 to a gear holding device 120 with for instance screws and screw-nuts. Moreover, the fixation part 370 has a connection recess 378 configured to slidingly engage and house the fixation end 368 of the attachment means 360. A locking protrusion 379 is arranged within the connection recess 378 and is configured to fit into the locking recess 369 of the fixation end 368 when the fixation part 370 and the attachment means 360 are connected to each other. On an opposite side of the fixation part 370 (shown in FIG. 8*a*), there is provided a lock release button 379'. The lock release button 379' is provided with a cord hole 379" through which for instance a string can be threaded such that the lock release button 379' can be pulled outwards, perpendicularly from the surface of the mating fixation part 370.

To connect the attachment means 360 to the mating fixation part 370 the fixation end 368 is placed in contact with a side surface 371 of the fixation part 370, and the fixation end 368 is slidingly pushed into the connection recess 378. To release the fixation part 370 from the attachment means 360, the user pulls the lock release button 379' laterally and pushes the fixation part 370 upwards in the direction indicated by the arrows in FIGS. 8*a* and 8*c*. When the lock release button 379' is pulled, the locking protrusion 379 will be moved out of the locking recess 369 and the mating fixation part 370 will be able to be slidingly released from the engagement between the fixation end 368 and the connection recess 378.

Figures 9A, 9B:
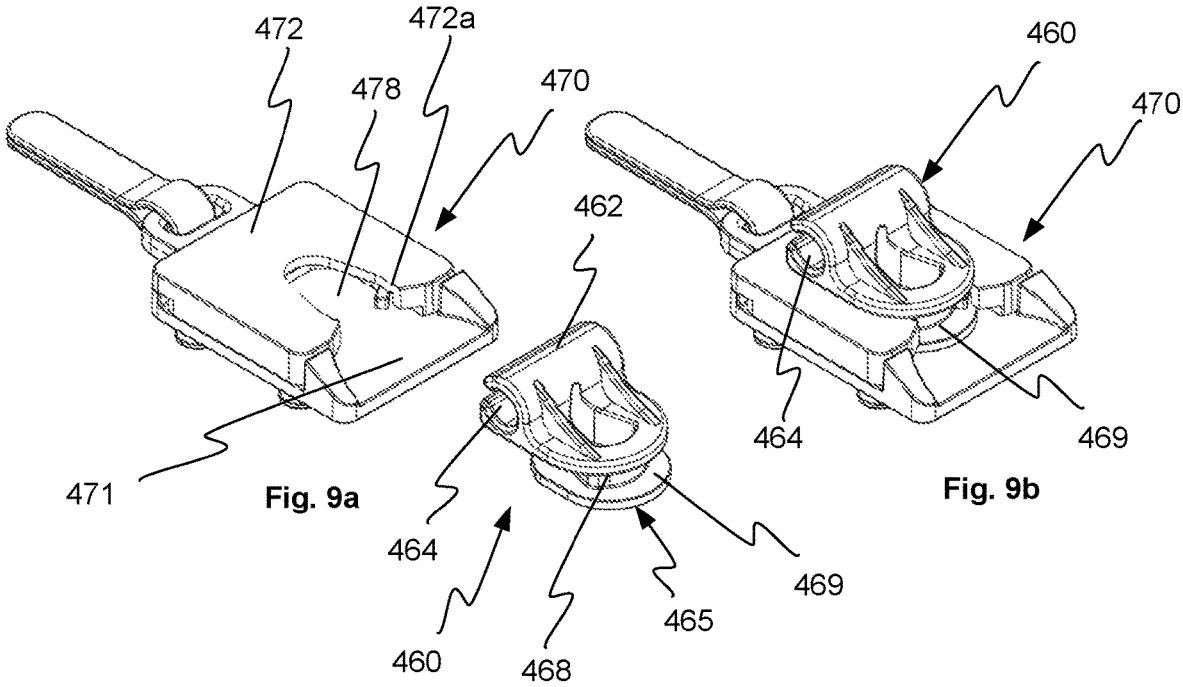
FIGS. 9*a-c* show an attachment means, and a mating fixation part.
Figure 9C:
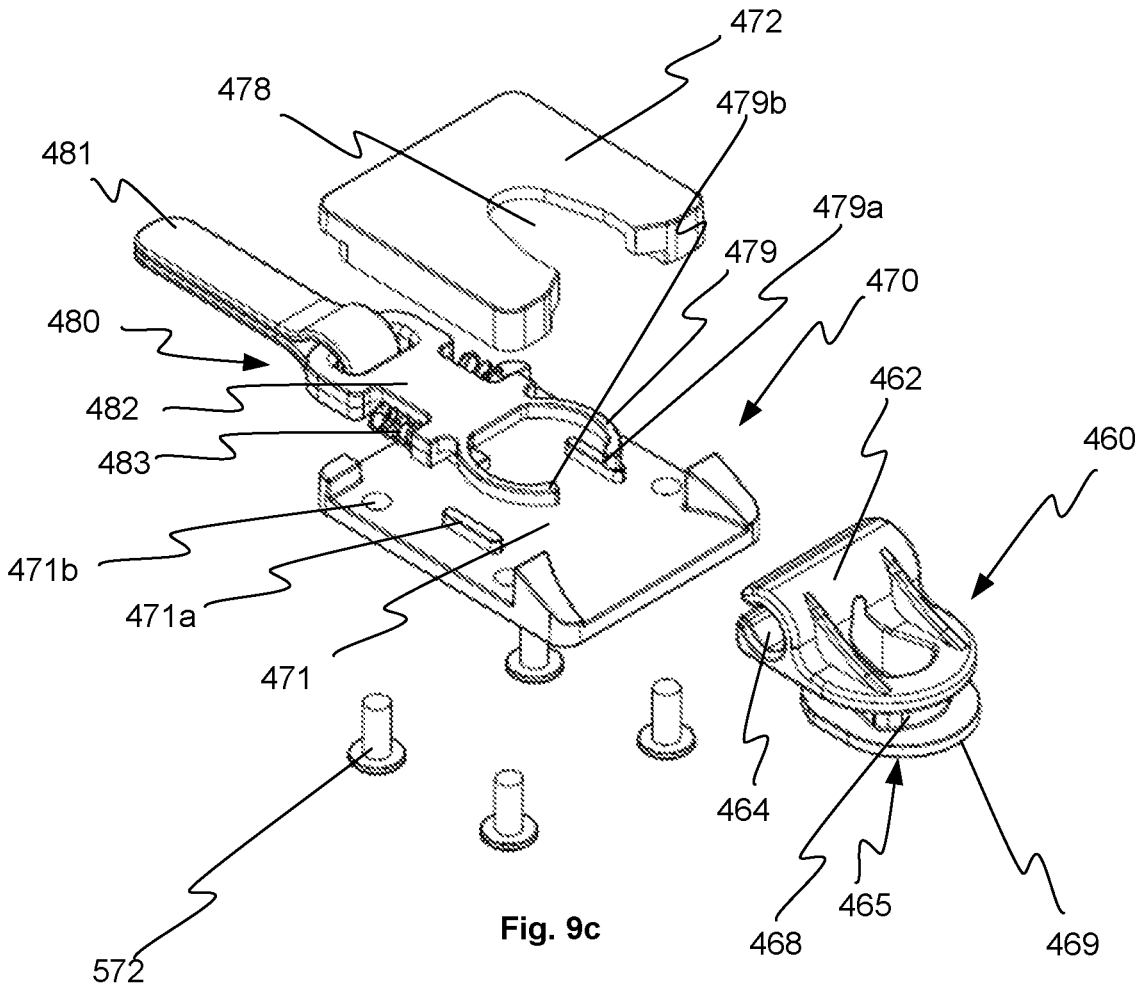

Another example of a fastening mechanism between a mating fixation part 470 and an exemplary attachment means 460 is shown in FIGS. 9*a* to 9*c*. In FIG. 9*a*, the attachment means 460 and the mating fixation part 470 are shown separated from each other. In FIG. 9*b*, the attachment means 460 is connected to the mating fixation part 470, and in FIG. 9*c*, the attachment means 460 and the mating fixation part 470 are shown separated from each other while the mating fixation part 470 is shown in an exploded view.

The attachment means 460 shown in FIGS. 9*a*-9*c* is similar to the attachments devices 160, 260 shown in FIGS. 3*a* to 7*b* and the attachment means 360 in FIGS. 8*b* and 8*d*. The attachment means 460 shown in FIGS. 9*a*-9*c* is provided a clutch 462 having a cavity 464. The clutch 462 is configured to engage and hold a connection element 152, 252 of an elongated garment portion 110, 210. Further, the attachment means 460 comprises a locking flange 469 arranged on an attachment portion 465, and a fixation end 468, in the form of a locking waist 468.

The mating fixation part 470 shown in FIG. 9*c* is provided with holes 471*b* which can be used to fasten the fixation part 470 to a gear holding device 120 with rivets 572 (or for instance screws and screw-nuts). Moreover, the mating fixation part 470 has a connection recess 478 configured to slidingly engage and house the attachment portion 465 of the attachment means 460, as shown in FIG. 9*b*.

Further, the mating fixation part 470 shown in FIG. 9*c* is provided with a handle portion 480 comprising a grip 481 and a handle 482. The grip 481 is mated to the handle 482 through a loop in the handle 482. The handle 482 further comprises two elastic members 483. The elastic member may be in the form of a spring.

FIG. 9*c* shows a locking mechanism of the fixation part 470, used to attach the attachment means 460 to the fixation part 470. To connect the attachment means 460 to the mating fixation part 470 the locking flange 469 of the attachment portion 465 is placed in contact with a base side surface 471 of the fixation part 470, and the attachment portion 465 is slidingly pushed into the connection recess 478.

With reference to FIG. 9*c*, a locking ring 479 is arranged within the connection recess 478 and is configured to enclose the locking waist 468 of the attachment portion 465 when the fixation part 470 and the attachment means 460 are connected to each other. The locking ring 479 has two locking ring ends 479*a*, 479*b*. Further, the locking ring 479 is made of a flexible material, such as a flexible metal material or a flexible plastic material. When the locking ring 479 does not engage the attachment means 460, as shown in FIGS. 9*a* and 9*c*, the distance between the locking ring ends 479*a*, 479*b* is smaller than the width the locking waist 468. Inner edges 472*a* of the fixation part upper portion 472 of the fixation part 470 prevents the locking ring 479 from expanding, since the locking ring ends 479*a*, 479*b* abut the inner edges 472*a* of the upper portion 472.

Therefore, when pressing the attachment means 460 into the fixation part 470, the locking flange 469 slides beneath the locking ring 479, and the locking waist 468 will exert force on the locking ring 479. Upon pushing the attachment means 460 into the connection recess 478 of the fixation part 470, the elastic members (in this case, springs) 483 will be compressed and the locking ring 479 is moved towards the loop in the handle 482. When the locking ring 479 is moved upwards the locking ring ends 479*a*, 479*b* pass the inner edges 472*a*, and the locking ring 479 expand, resulting in more space between the locking ring ends 479*a*, 479*b* such that there is room for the locking waist 468. The locking ring 479 then snaps back around the locking waist 468 and engage the locking waist 468. If the user tries to pull and detach the attachment means 460 from the fixation part 470, the locking ring ends 479*a*, 479*b* cannot expand since the inner edges 472*a* lock the position of the locking ring 479. In the attached position, stabilisers 471*a* on the base side surface 471 hold the attachment means 460 in a stable position. The locking waist 468 has substantially straight side edges which will abut the stabilisers 471*a* when the attachment means 460 is connected to the fixation part 470.

To detach the attachment means 460 from the fixation part 470, the user pulls the grip 481 and/or handle 482 such that the springs 483 are compressed and the locking ring 479 is moved towards the handle 482. In this position, the locking ring ends 479*a*, 479*b* have room for expansion inside the fixation part 470. When the locking ring 479 expands, the distance between the locking ring ends 479*a*, 479*b* is larger than the width of the locking waist 468, and the attachment means 460 may be pulled out from the connection recess 478. When the locking ring 479 and the locking ring ends 479*a*, 479*b* expands, the attachment means 460 can be pulled and disconnected from the fixation part 470.

In one embodiment, there is disclosed a locking mechanism for a fixation part 470 configured to attach an attachment means 460 to said fixation part 470. The locking mechanism comprises a handle 482 with at least one elastic member 483. The locking mechanism comprises a locking ring 479 configured to engage the attachment means 460. The elastic member 483 may be in the form of a spring.

In one embodiment, the locking ring 479 has two locking ring ends 479*a*, 479*b*. The locking ring 479 does not have room for expansion when the elastic member 483 is in its relaxed state. A distance between said two locking ring ends 479*a*, 479*b* is smaller than a width of the attachment means 460 when the elastic member 483 is in its relaxed state. Furthermore, a distance between said two locking ring ends 479*a*, 479*b* is larger than a width of the attachment means 460 when the elastic member 483 is in its compressed state. Moreover, the locking ring 479 has room for expansion in the fixation art 470 when the elastic member 483 is in its compressed state.

In one embodiment, the two locking ring ends 479*a*, 479 abut inner edges 472*a* of the fixation part 470 when the elastic member 483 is in its relaxed state, preferably the inner edges 472*a* being inner edges of a fixation part upper portion 472 of the fixation part 470. More preferably, the locking ring ends 479*a*, 479*b* cannot expand when the elastic member 483 is in its relaxed state since the inner edges 472*a* lock the position of the locking ring 479.

The attachment means 160, 260, 360, 460 and the mating fixation part 370, 470 may be made of a plastic material, or a metal.

All attachment means 160, 260, 360, 470 disclosed herein may be adjusted along the extension of the connection element 152, 252 disclosed herein. In that way, the user can easily adjust the work wear garment 100, 200 to fit a particular use. In addition, the attachment means 160, 260, 360, 460 provide flexibility for the user to choose different number of attachment means 160, 260, 360, 460 and different gear holding devices 120. Various numbers of attachment means 160, 260, 360, 460 may be used, and the user can adapt the number and type of gear holding device 120 depending on present needs. Each gear holding device 120 may in turn be fastened using one or several attachment means 160, 260, 360, 460 such as two attachment means 160, 260, 360, 460 (shown in FIG. 5*b*), or three or four attachment means 160, 260, 360, 460 (not shown).

The attachment means 160, 260, 360, 460 are simple to detach for the user, while ensuring a secure fixation of the gear holding devices 120 during use. Hence, the garment 100, 200 is modular and may be adapted for several purposes on a daily basis. In addition, the gear holding devices 120 and the attachment means 160, 260, 360, 460 may be released from the garment connection portion 150, 250 for instance for washing of the garment 100, 200 and may be exchanged in the event of damages. Thus, it is not necessary to buy a new garment 100, 200 if the gear holding devices 120 need to be exchanged. Oppositely, it is not necessary to buy new gear holding devices 120 if the garment 100, 200 is to be replaced.

An end of the elongated garment portion 110, 210 may comprise a locking feature (not shown), such that the attachment means 160, 260, 360, 460 cannot slide off the elongated garment portion 110, 210. Such locking feature may for instance be a flange releasably connectable by a snip-fit button such that is covers the end of the elongated garment portion 110, 210 in a closed state.

The garment connection portion 150, 250 may be made of a woven or non-woven material. Preferably, garment connection portion 150, 250 is made of a material comprising nylon, such as Cordura fabric or Kevlar, an ultra-high-molecular-weight polyethylene (UHMWP), such as Dyneema cord or Spectra, or a combination thereof. The garment connection portion 150, 250 may also be formed of a plastic or comprise a metal, such as a steel rail.

Optionally, the elongated garment portion 110, 210 is a strap, which may be attached to and integrated in said garment 100, 200. In such case, the garment arrangement 1000, 2000 comprises a garment 100, 200, and the strap which is provided with a strap connection portion and which is at least partly integrated within or attached to the garment 100, 200. The garment arrangement 1000, 2000 also comprises an attachment means 160 configured to be releasably connected to the strap connection portion. The attachment means 160 is configured to be movable along the extension of the strap.

Methods 500, 500' for connecting at least one attachment means 160, 260, 360, 460 to an elongated garment portion 110, 210 of a garment arrangement will now be explained with reference to the FIGS. 10*a*-*b*.

Figure 10A:
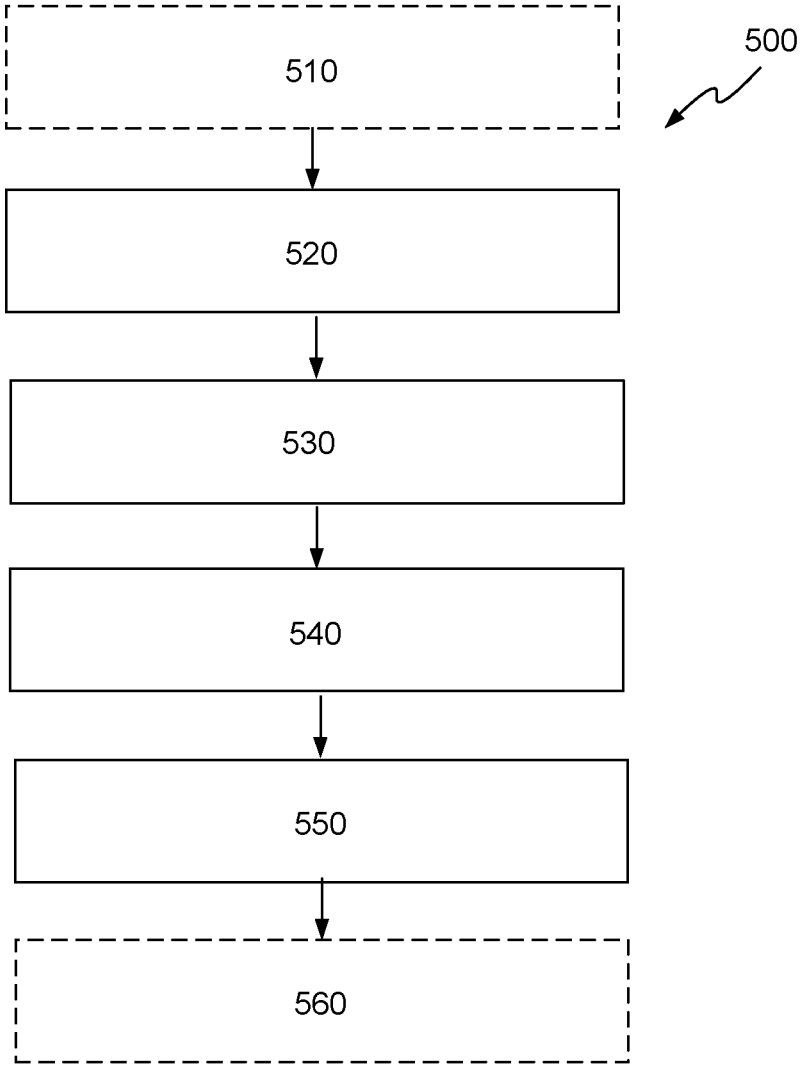
FIGS. 10*a-b* are flowcharts illustrating methods for attaching a gear holding device to a garment.

The method 500 shown in FIG. 10*a* comprises an optional first step of putting on 510 the garment 100, 200. The method is followed by a step of providing 520 a garment 100, 200 having an elongated garment portion 110, 210 provided with at least one garment connection portion 150, 250. Then, the attachment means 160, 260, 360, 460 is provided 530 and the attachment means 160, 260, 360, 460 is releasably connected 540 to the garment connection portion 150, 250 and is adjusted 550 to a preferred position along the garment connection portion 150, 250.

The next step involves releasably connecting 560 the mating fixation part 370 to the fixation end 368 of the attachment means 160, 260, 360, 460. The fixation part 370 is connected to the gear holding device 120.

Figure 10B:
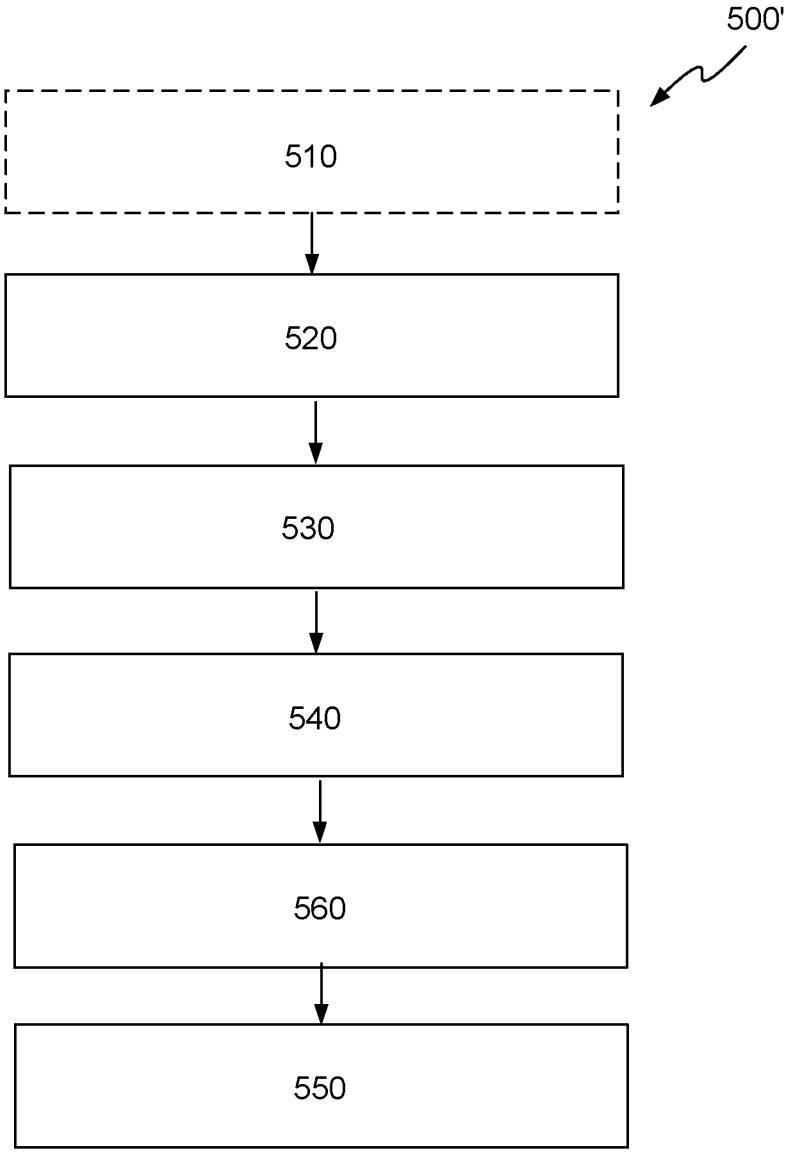

Another method 500' is disclosed in FIG. 10*b*. The method discloses an optional step of firstly putting on 510 the garment 100, 200. Further, in this method the step of connecting 560 the mating fixation part 370, 470 to the fixation end 368 or locking waist 468 of said attachment means 160, 260, 360, 460 is conducted before the step of adjusting 550 the attachment means 160, 260, 360, 460 to a preferred position along the garment connection portion 150, 250.

When attaching the attachment means 160, 260, 360, 460 to the garment connection portion 150, 250, the garment connection portion 150, 250 is fitted into the cavity 164, 264, 364, 464 of the clutch 162, 262, 362, 462 from a lateral direction.

The invention claimed is:

1. A garment arrangement, comprising:

a garment, having an elongated garment portion that extends along and around a waistband of said garment, wherein the extension of the elongated garment portion along and around the waistband defines a waistband direction, wherein the elongated garment portion is provided with a garment connection portion and a base, and wherein the waistband has a width in a lateral direction of the garment that is perpendicular to a longitudinal direction of the garment, and an attachment member configured to be releasably connected to said garment connection portion, and wherein said attachment member is configured to be movable along said elongated garment portion, wherein:

said base comprises an upper portion and a lower portion, wherein the lower portion is positioned below the upper portion with respect to the longitudinal direction of the garment; and said garment connection portion comprises:

a projecting part in the form of a strap or flange, the projecting part comprising:

an upper end connected to the upper portion of said base; and a remote end that is movable towards and away from said base, the remote end being positioned below the upper end with respect to the longitudinal direction of the garment; and a connection element being arranged at the remote end of said projecting part, wherein:

said connection element is in the form of a rail and said attachment member is configured to releasably slidingly engage said rail, wherein said attachment member comprises a clutch opening and a clutch cavity;

said rail comprises:

an inward facing surface that faces toward the base along a radial direction that is perpendicular to both the waistband direction and the longitudinal direction of the garment; and an outward facing surface that faces away from the base along the radial direction that is perpendicular to both the waistband direction and the longitudinal direction of the garment; and both the inward facing surface of the rail and the outward facing surface of the rail are in contact with an inner surface of the clutch cavity when said attachment member is releasably slidingly engaged with said rail.

2. The garment arrangement according to claim 1, further comprising an attachment portion extending from the attachment member, wherein said attachment portion is configured to be connected to a gear holding device.

3. The garment arrangement according to claim 2, wherein said attachment portion is configured to be connected to the gear holding device by at least one of screws, bolts, rivets, stitches, or an adhesive.

4. The garment arrangement according to claim 1, further comprising:

a gear holding device; and an attachment portion extending from the attachment member, wherein the gear holding device is connected to said attachment portion through a mating fixation part engaging a fixation end of the attachment portion.

5. The garment arrangement according to claim 4, wherein said mating fixation part is connected to the gear holding device by screws, bolts, rivets, stitches or an adhesive.

6. The garment arrangement according to claim 4, wherein the gear holding device is a tool holder, a loop, a pocket, or an advanced pocket having a plurality of sub-pockets, loops, and/or tool holders.

7. The garment arrangement according to claim 1, wherein said rail has a substantially circular cross-section.

8. The garment arrangement according to claim 1, wherein said rail has a substantially rectangular cross-section.

9. The garment arrangement according to claim 1, wherein said garment connection portion comprises textile parts.

10. The garment arrangement according to claim 9, wherein said garment connection portion is made of a material comprising nylon.

11. The garment arrangement according to claim 1, wherein said garment is a trouser or a jacket.

12. The garment arrangement according claim 1, wherein said garment is a work wear garment.

13. A method for connecting an attachment member to an elongated garment portion of a garment arrangement, wherein the method comprises the steps of:

providing a garment having the elongated garment portion, wherein the elongated garment portion extends along and around a waistband of said garment and is provided with a garment connection portion and a base, wherein the extension of the elongated garment portion along and around the waistband defines a waistband direction, and wherein the waistband has a width in a lateral direction of the garment that is perpendicular to a longitudinal direction of the garment;

providing the attachment member; and releasably connecting the attachment member to the garment connection portion; and adjusting the attachment member to a preferred position along the garment connection portion, wherein:

said base comprises an upper portion and a lower portion, wherein the lower portion is positioned below the upper portion with respect to the longitudinal direction of the garment; and said garment connection portion comprises:

a projecting part in the form of a strap or a flange, the projecting part comprising:

an upper end connected to the upper portion of said base; and a remote end that is movable towards and away from said base, the remote end being positioned below the upper end with respect to the longitudinal direction of the garment; and a connection element being arranged at the remote end of said projecting part, wherein:

said connection element is in the form of a rail and said attachment member is configured to releasably slidingly engage said rail, wherein said attachment member comprises a clutch opening and a clutch cavity;

said rail comprises:

an inward facing surface that faces toward the base along a radial direction that is perpendicular to both the waistband direction and the longitudinal direction of the garment; and an outward facing surface that faces away from the base along the radial direction that is perpendicular to both the waistband direction and the longitudinal direction of the garment; and both the inward facing surface of the rail and the outward facing surface of the rail are in contact with an inner surface of the clutch cavity when said attachment member is releasably slidingly engaged with said rail.

14. The method according to claim 13, wherein:

an attachment portion extends from the attachment member; and the method further comprises the step of:

connecting a mating fixation part to a fixation end of said attachment portion, wherein said mating fixation part is connected to a gear holding device.

15. The method according to claim 13, wherein the method further comprises a step of putting on the garment before the steps of releasably connecting the attachment member to the garment connection portion and adjusting the attachment member to the preferred position along the garment connection portion.

16. The method according to claim 14, wherein the step of connecting the mating fixation part to the fixation end of said attachment portion is conducted before the step of adjusting the attachment member to the preferred position along the garment connection portion.

17. A garment comprising:

a waistband having a width in a lateral direction of the garment that is perpendicular to a longitudinal direction of the garment; and an elongated garment portion comprising a base and a garment connection portion, wherein each of the base and the garment connection portion extend along and around the waistband of the garment, wherein the extension of the base and the garment connection portion along and around the waistband defines a waistband direction, wherein:

the base comprises an upper portion and a lower portion, wherein the lower portion is positioned below the upper portion with respect to the longitudinal direction of the garment; and the garment connection portion comprises:

a projecting part in the form of a strap or flange, the projecting part comprising:

an upper end connected to the upper portion of said base; and a remote end that is movable towards and away from said base, the remote end being positioned below the upper end with respect to the longitudinal direction of the garment; and a connection element in the form of a rail arranged at the remote end of said projecting part and configured for releaseable and sliding engagement with an attachment member comprising a clutch opening and a clutch cavity, wherein:

said rail comprises:

an inward facing surface that faces toward the base along a radial direction that is perpendicular to both the waistband direction and the longitudinal direction of the garment; and an outward facing surface that faces away from the base along the radial direction that is perpendicular to both the waistband direction and the longitudinal direction of the garment; and both the inward facing surface of the rail and the outward facing surface of the rail are in contact with an inner surface of the clutch cavity when said attachment member is releasably slidingly engaged with said rail.

18. The garment of claim 17, wherein each of the base and the garment connection portion extend along and around the waistband from a first side of the waistband to a second side of the waistband opposite the first side.

* * * * *